United States Patent [19]

Sassa

[11] Patent Number: 4,835,845

[45] Date of Patent: Jun. 6, 1989

[54] PARTS APPLICATOR FOR SLIDE FASTENERS

[75] Inventor: Yusei Sassa, Namerikawa, Japan

[73] Assignee: Yoshida Kogyo K. K., Tokyo, Japan

[21] Appl. No.: 227,635

[22] Filed: Aug. 3, 1988

[30] Foreign Application Priority Data

Aug. 4, 1987 [JP] Japan ..... 62-195977

[51] Int. Cl.[4] ..... A41H 37/06

[52] U.S. Cl. ..... 29/767; 29/408

[58] Field of Search ..... 29/33.2, 408, 766, 767

[56] References Cited

U.S. PATENT DOCUMENTS

| | | | |
|---|---|---|---|
| 3,504,418 | 7/1970 | Perlman . | |
| 3,530,563 | 9/1970 | Maeda | 29/767 |
| 4,307,511 | 12/1981 | Yoshida | 29/767 |
| 4,520,544 | 6/1985 | Morita et al. | 29/408 |
| 4,697,319 | 10/1987 | Umino | 29/767 |

FOREIGN PATENT DOCUMENTS

| | | |
|---|---|---|
| 0099064 | 3/1984 | European Pat. Off. . |
| 0160982 | 6/1985 | European Pat. Off. . |
| 2022684A | 5/1979 | United Kingdom . |
| 2088945A | 11/1982 | United Kingdom . |

*Primary Examiner*—P. W. Echols

*Attorney, Agent, or Firm*—Hill, Van Santen, Steadman & Simpson

[57] ABSTRACT

A parts applicator for applying fastener parts such as pins of a separable end stop to a fastener chain includes an anvil slidably mounted in an oscillatable holder and having a pocket in which each fastener part is releasably received. The holder is angularly moved between a reclining position and an upstanding position in which the pocket is located on the path of movement of the slide fastener chain. The parts applicator further includes a cam mechanism acting on the anvil when the holder performs a part of its angular reciprocation adjacent to the upstanding position, for causing the anvil to reciprocate linearly relative to the holder while moving angularly together with the holder.

8 Claims, 3 Drawing Sheets

PARTS APPLICATOR FOR SLIDE FASTENERS

BACKGROUND OF THE INVENTION

1. Field of the Invention

The present invention relates to a parts applicator for applying a separable end stop during a process of manufacturing a separable slide fastener.

2. Prior Art

Separable slide fasteners are successively manufactured from an elongate continuous slide fastener chain by processing the slide fastener chain in various successive steps. As shown in FIG. 4, the slide fastener chain 1 includes a pair of intermeshing rows of coupling elements 2, 2 mounted on the respective inner longitudinal edges of slide fastener stringer tapes 4, 4. In one processing step, element-free spaces 3 are defined in the rows of coupling elements 2 at equally spaced intervals. In a subsequent processing step, an auxiliary film 5 of thermoplastic synthetic resin is ultrasonically applied or fused to the stringer tapes 4 across one of the element-free spaces 3 near one end thereof for reinforcing the lower end of a prospective separable slide fastener in which a separable end stop is to be attached. Thereafter, a separable pin 6 and a retainer pin 7 of the separable end stops are applied by clinching to reinforced portions of the respective stringer tapes 4 astride the inner longitudinal edges thereof. One known device for applying such pins 6, 7 includes an anvil angularly movable into the element-free space 3 while holding thereon separable and retainer pins 6, 7 in parallel spaced relation to one another. When the anvil is disposed in the element-free space, the pins 6, 7 are fitted over and around the respective inner longitudinal edges of the stringer tapes 4. While keeping this condition, a vertically reciprocating punch is lowered toward the anvil to thereby clinch the pins 6, 7 to the stringer tapes 4.

The anvil of the known applying device is composed of a fixed lower jaw and a movable upper jaw disposed at an upper end of the anvil for releasably holding therebetween the pins. The anvil is tilted down from a vertical position to a horizontal position to receive the pins between the upper and lower jaws and then raised to project the upper jaw into the element-free space 3. In this instance, the upper jaw is likely to interfere with the confronting inner longitudinal edges of the stringer tapes 4, thereby splitting the interengaged rows of coupling elements 2 from the element-free space 3. This problem does not occur when the individual element-free spaces 3 are elongated to a certain extent. Such elongated element-free spaces would result in wastage of material when separable slide fasteners are mass-produced.

SUMMARY OF THE INVENTION

In view of the foregoing problems, it is an object of the present invention to provide a parts applicator for applying fastener parts, such as separable and retainer pins of a separable end stop, to an elongate slide fastener chain adjacent to an element-free space without causing forcible separation or splitting of a pair of intermeshing rows of coupling elements from the element-free space and without the necessity of wasteful elongation of the element-free space.

To achieve the foregoing object, there is provided according to the present invention an apparatus for applying a fastener part to a slide fastener chain, comprising an oscillatable holder angularly movable between an applying position in which the holder is upstanding directly below a vertically reciprocating punch, and a standby position in which the holder is reclined, the holder being further reciprocably movable toward and away from the path of movement of the punch while the holder is being inclined. An anvil is slidably mounted in the holder and has a fixed lower jaw and a movable upper jaw defining therebetween a pocket for receiving therein the fastener part, the upper jaw being movable toward and away from said lower jaw for releasably holding the fastener part in the pocket. A cam mechanism acts on the anvil when the holder performs a part of its angular reciprocation adjacent to the applying position, for causing the anvil to reciprocate linearly relative to the holder while moving angularly together with the holder.

Many other advantages and features of the present invention will become manifest to those versed in the art upon making reference to the detailed description and the accompanying sheets of drawings in which a preferred structural embodiment incorporating the principles of the present invention are shown by way of example.

DETAILED DESCRIPTION

Figure 2:
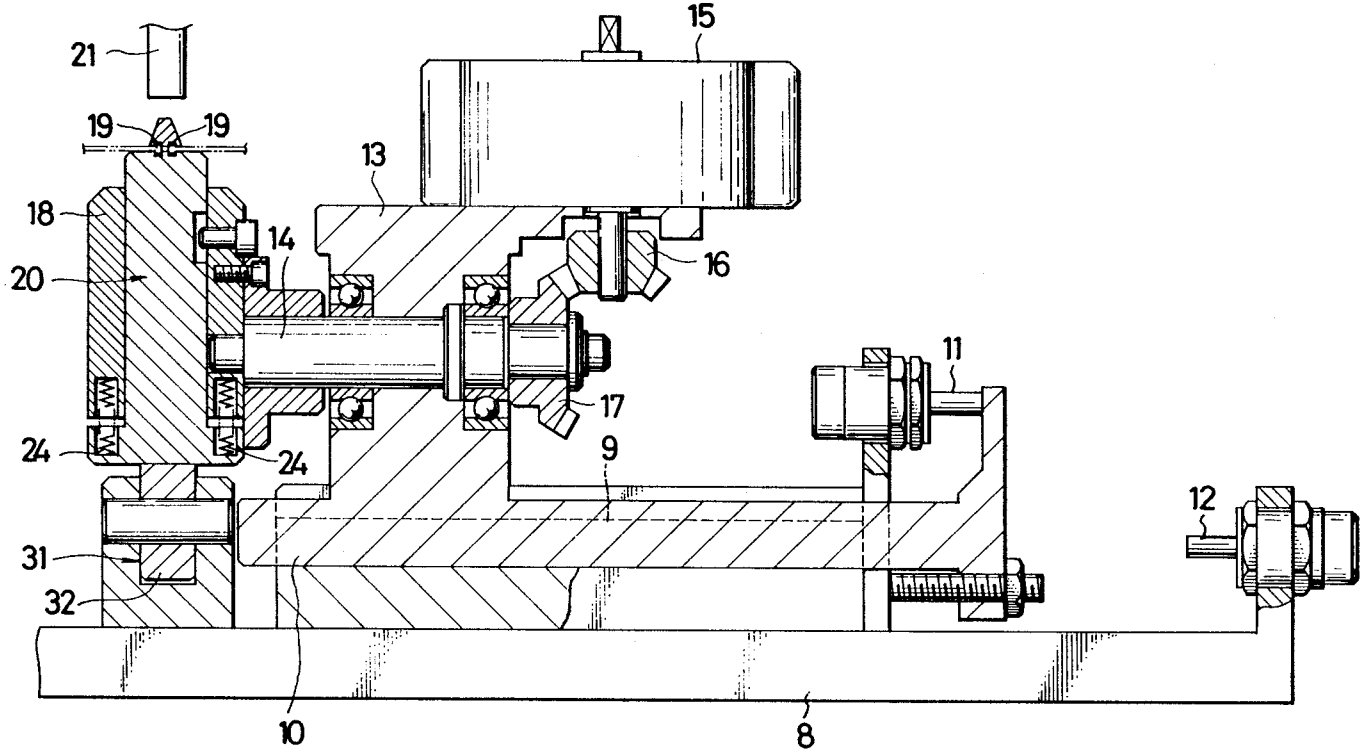
FIG. 2 is a vertical cross-sectional view showing the general construction of the parts applicator.
Figure 4:
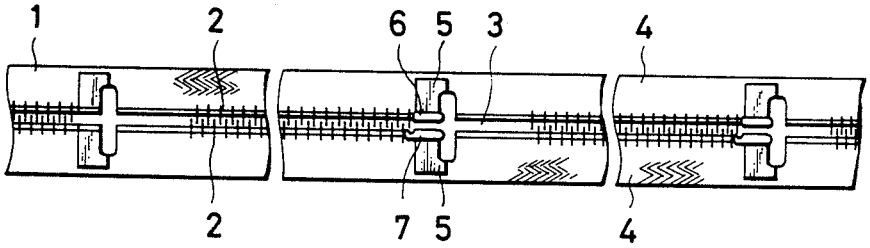
FIG. 4 is a fragmentary plan view of a slide fastener chain with separable and retainer pins applied thereto.

As shown in FIG. 2, a part applicator embodying the present invention comprises an elongate bed 8 having on its upper surface a transverse guide groove 9 for slidably receiving therein a support block 10. The support block 10 is operatively connected with a cylinder actuator (not shown) for reciprocating movement along the guide groove 9 within a distance which is determined by a pair of spaced stoppers 11, 12. The stoppers 11, 12 are mounted on the bed 8 at the rear end thereof and engageable with the rear end of the support block 10 to limit opposite ends of the stroke of the support block 10. The support block 10 includes an upstanding portion 13 for rotatably supporting therein a horizontal shaft 14. The horizontal shaft 14 is connected in driven relation to a motor 15 via a pair of intermeshing bevel gear 16, 17 for oscillation through an angle of 90 degrees. The shaft 14 has an output end secured to a holder 18 for oscillating the latter. The holder 18 includes an anvil 20 slidably received therein for reciprocation along a longitudinal axis of the holder 18. The anvil 20 has a pair of laterally spaced pockets 19, 19 for releasably holding therein a pair of fastener parts, respectively. In the illustrated embodiment, the fastener parts comprise a separable pin 6 and a retainer pin 7 of a separable end stop, as shown in FIG. 4.

Figure 1:
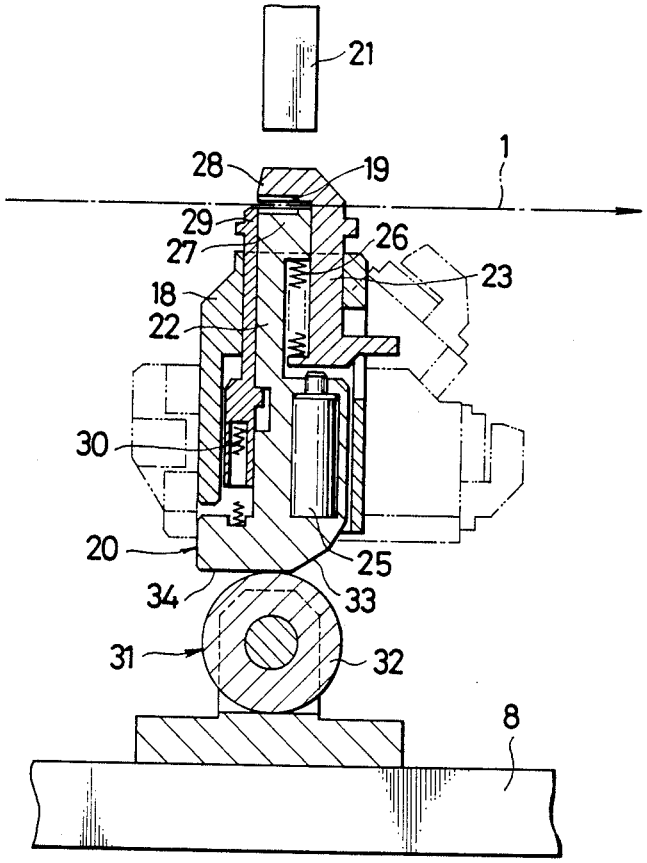
FIG. 1 is a vertical cross-sectional view of a parts applicator according to the present invention.

As shown in FIG. 1, the holder 18 is adapted to be tilted down rightward from an erected or upstanding position (applying position) indicated by solid lines to a reclining position (standby position) indicated by phantom lines, then retracted rearwardly (rightward in FIG.

2) away from a punch 21 to receive separable and retainer pins which are supplied from a chute connected to a parts feeder (neither shown) in the respective pockets 19, 19. Thereafter the holder 18 is advanced toward the punch 21, then angularly moved back to the solid-lined upstanding position to hold the pins around the respective inner longitudinal edges of the stringer tapes 4. Finally, the punch 21 is lowered toward the upstanding holder 18, thereby clinching the pins to the fastener tapes 4.

The anvil 20, as shown in FIG. 1, is composed of a main body 22 and an auxiliary body 23. The main body 22 is slidably disposed in the holder 18 and normally urged downwardly by a pair of compression coil springs 24 (FIG. 2) acting between the holder 18 and a lower end of the main body 22. The auxiliary body 23 is also slidably received in the holder 18 and extends parallel to an upper part of the main body 22, so that the auxiliary body 23 is slidable in a direction parallel to the direction of movement of the main body 22. The main body 22 supports therein a cylinder actuator 25 for thrusting the auxiliary body 23 upwardly against the force of a compression coil spring 26 acting between the main body 22 and the auxiliary body 23.

The main body 22 has a lower jaw 27 at an upper end thereof and the auxiliary body 23 has upper jaw 28 extending over the lower jaw 27 so as to define therebetween the above-mentioned pockets 19, 19 (FIG. 2) in which the separable and retainer pins are releasably retained. A retaining finger 29 is slidably received between the holder 18 and the main body 22 and reciprocally movable parallel to the main body 22. The retaining finger 29 is normally urged upwardly by a compression coil spring 30 acting between a lower end of the retainer finger 29 and a lower end portion of the main body 22. The retainer finger 29 is disposed on an inlet side of the pockets 19, 19 and normally extends partly into inlets of the pockets 19, 19 so as to prevent the pins from displacing off the pockets 19, 19 during movement of the anvil 20.

The parts applicator further includes a cam mechanism 31 for controlling the movement of the pocket 19 of the anvil 20 during angular reciprocation of the holder 18 between the upstanding position and the reclining position.

The cam mechanism 31 includes, as shown in FIG. 1, a cylindrical cam roller 32 rotatably supported on the bed 8 at a position immediately below the main body 22 of the anvil 20 when the holder 18 is disposed in its upstanding position, and an angled cam surface formed on the lower end of the main body 22. The angled cam surface is composed of an oblique cam surface 33 and a horizontal cam surface 34 extending contiguously from the lower end of the oblique cam surface 33. The main body 22 of the anvil 20 is urged by the compression coil spring 24 (FIG. 2) against the circumferential surface of the cam roller 32.

The parts applicator of the foregoing construction operates as follows. The holder 18 is normally held in the reclining horizontal standby position indicated by the phantom lines in FIG. 1 in which the reclining holder 18 is disposed below the punch 21. An elongate slide fastener chain 1 (identical to the slide fastener chain 1 substantially as described with reference to FIG. 4 excepting that the separable and retainer pins 6, 7 have not been applied) is fed intermittently by a suitable feed unit (not shown) along a horizontal feed path on which the pockets 19 of the anvil 20 are located when the holder 18 is upstanding. While the slide fastener chain 1 is at rest, an end of one of the element-free spaces 3 is disposed directly below the punch 21.

While the slide fastener chain 1 is being longitudinally fed along the feed path, the non-illustrated cylinder actuator is operated to move the support block 10 rearwardly until the support block 10 engages the stopper 12, thereby retracting the holder 18 away from the punch 21 while keeping the reclining posture of the holder 18. A separable pin 6 and a retainer pin 7 are supplied from non-illustrated chute to the respective pockets 19, 19 in the anvil 20. Thereafter, the cylinder actuator is operated again to move the support block 10 forwardly until the support block 10 engages the stopper 11, thus advancing the holder 18 in a position below the punch 21.

When the slide fastener chain 1 is stopped, the motor 15 (FIG. 2) is driven to turn the shaft 14 in a direction to move the holder 18 angularly upwardly from the reclining position to the upstanding position. During this upward angular movement of the holder 18, the anvil 20 first moves angularly upwardly together with the holder 18 until the oblique cam surface 33 of the main body 22 engages the cam roller 32, then slides upwardly along the longitudinal axis of the holder 18 under the coaction of the oblique cam surface 33 and the cam roller 32 while it continues angular upward movement coincident with the angular upward movement of the holder 18. This combined sliding-and-angular movement of the anvil 20 causes the pockets 19 to move linearly upwardly along the oblique straight path stated above. As the holder 18 approaches its upstanding position, the upper jaw 28 of the anvil 20 projects into the element-free space 3. The angular upward movement of the holder 18 is terminated when the holder 18 arrives at its upstanding position in which the horizontal cam surface 34 rests on the cam roller 32. In this instance the respective inner longitudinal edges of the stringer tapes 4 are received in the pockets 19 in the anvil 20 with the separable and retainer pins 6, 7 disposed astride the inner longitudinal edges. Then the punch 21 is driven toward the anvil 20, thereby clinching the pins 6, 7 to the inner longitudinal edges of the stringer tapes 4 by and between the upper and lower jaws 28, 27.

Then the cylinder actuator 25 is operated to move the upper jaw 28 upwardly away from the lower jaw 27 against the force of the compression coil spring 26, thereby releasing the pins 6, 7 secured to the stringer tapes 4. The shaft 14 (FIG. 2) is turned by the motor 14 to move the holder 18 from the upstanding to the inclining position. During that time, the pockets 19 in the anvil 20 moves downwardly first along the oblique straight path and then along the arcuate path under the action of the cam mechanism 31. Upon arrival of the holder 18 at the reclining standby position, the slide fastener chain 1 is advanced again and the foregoing sequence of operation is repeated.

Figure 3:
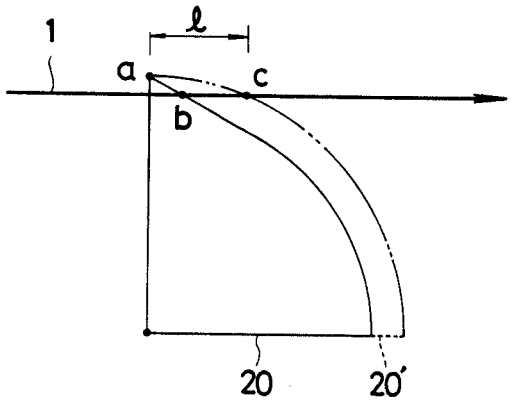
FIG. 3 is a diagrammatic view illustrative of a locus of movement of an anvil of the parts applicator shown in FIG. 1 as compared to the locus of movement of an anvil of a known parts applicator.

FIG. 3 comparatively shows a locus of movement of the upper end of the anvil of the present invention and a locus of movement of the upper end of an anvil 20' of a conventional parts applicator, which loci are traced when the upper ends of the respective anvils 20, 20' reciprocate between the lower horizontal position and the upper vertical position a. As indicated by solid lines in this figure, the locus of movement of the anvil 20 is composed of an arcuate line extending upwardly from the lower horizontal position and terminating short of the upper vertical position a, and an oblique straight line contiguous to an upper end of the arcuate line and extending across the horizontal path of movement of the slide fastener chain 1 at a position b. The locus of movement of the conventional anvil 20', as indicated by phantom lines, is composed solely of an arcuate line extending across the horizontal path of movement of the slide fastener chain 1 at a position c which is located downstream of the point b. As appears clear from the loci, if the individual element-free spaces have a length 1 which is substantially equal to the distance between the position a and the position c, the upper end of the conventional anvil 20' will interfere with the inner longitudinal edges of the stringer tapes 4 at one end of the element-free space 3, tending to spread the intermeshing rows of coupling elements 2 from the end of the element-free space 3. To prevent the forcible separation or splitting of the rows of coupling elements 2, the element-free space 3 must be long enough to allow passage of the upper end of the conventional anvil 20' without interference with the inner longitudinal tape edges. The elongated element-free space is however disadvantageous as it will produce a large wastage of material when mass-producing the separable slide fastener. Conversely, the point b of intersection between the locus of movement of the upper end of the anvil 20 and the path of movement of the slide fastener chain 1 is located intermediately of the element-free space 3. Consequently, the upper end of the anvil 20 can be moved into and out of the element-free space 3 without undue interference with the inner longitudinal edges of the stringer tapes 4. With the use of the parts applicator of the present invention, it is possible to apply the pins 6, 7 reliably to the slide fastener chain 1 without causing separation of the intermeshing rows of coupling elements.

Obviously, various modifications and variations of the present invention are possible in the light of the above teaching. It is therefore to be understood that within the scope of the appended claims the invention may be practiced otherwise than as specifically described.

What is claimed is:

1. An apparatus for applying a fastener part to a slide fastener chain, comprising:

(a) a vertically reciprocating punch;

(b) an oscillatable holder angularly movable between an applying position in which said holder is upstanding directly below said punch, and a standby position in which said holder is reclined, said holder being further reciprocably movable toward and away from the path of movement of said punch when said holder is in the inclined position;

(c) an anvil slidably mounted in the holder and having a fixed lower jaw and a movable upper jaw defining therebetween a pocket for receiving therein the fastener part, said upper jaw being movable toward and away from said lower jaw for releasably holding said fastener part in said pocket; and (d) a cam mechanism acting on said anvil when said holder performs a part of its angular reciprocation adjacent to said applying position, for causing said anvil to reciprocate linearly relative to said holder while moving angularly together with said holder.

2. An apparatus according to claim 1, said part of the angular reciprocation of said holder defining an angle not more than 45 degrees with respect to said applying position.

3. An apparatus according to claim 1, said cam mechanism including a cam roller disposed below said holder in registry with the path of movement of said punch, and an angled cam surface on a lower end of said anvil and engageable with said cam roller when said holder performs said part of its angular reciprocation.

4. An apparatus according to claim 3, said angled cam surface being composed of an oblique cam surface and a horizontal cam surface contiguous to a lower end of said oblique cam surface.

5. An apparatus according to claim 3, said anvil including a main body slidably received in said holder and having said lower jaw and said angled cam surface, an auxiliary body slidably received in said holder and having said upper jaw, spring means acting between said main body and said auxiliary body for urging the latter in a direction to move said upper jaw toward said lower jaw, and an actuator mounted in said main body for moving said auxiliary body in a direction to cause said upper jaw to move away from said lower jaw.

6. An apparatus according to claim 5, said actuator comprising a cylinder actuator embedded in said main body.

7. An apparatus according to claim 5, said anvil further including a retainer finger slidably disposed between said main body and said holder for partly closing an inlet of said pocket to prevent the fastener part from displacing from said pocket.

8. An apparatus according to claim 3, said anvil further including means for urging said main body in a direction to cause said angled cam surface to engage said cam roller.

* * * * *